US008916512B2

(12) United States Patent
Holland et al.

(10) Patent No.: US 8,916,512 B2
(45) Date of Patent: Dec. 23, 2014

(54) SURFACTANT COMPONENT AND A COMPOSITION INCLUDING THE SAME

(75) Inventors: Richard J. Holland, Flanders, NJ (US); Mary A. Kinsella, Brownstown, MI (US); Mark Thompson, Southgate, MI (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/805,801

(22) PCT Filed: Jun. 10, 2011

(86) PCT No.: PCT/US2011/039984
§ 371 (c)(1),
(2), (4) Date: Dec. 20, 2012

(87) PCT Pub. No.: WO2012/005868
PCT Pub. Date: Jan. 12, 2012

(65) Prior Publication Data

US 2013/0096047 A1 Apr. 18, 2013

Related U.S. Application Data

(60) Provisional application No. 61/356,791, filed on Jun. 21, 2010.

(51) Int. Cl.

| | |
|---|---|
| ***C11D 1/72*** | (2006.01) |
| ***C11D 1/825*** | (2006.01) |
| ***C11D 1/835*** | (2006.01) |
| ***C11D 3/00*** | (2006.01) |
| *C11D 1/62* | (2006.01) |

(52) U.S. Cl.
CPC ..... *C11D 3/0015* (2013.01); *C11D 1/8255* (2013.01); *C11D 1/8355* (2013.01); *C11D 1/62* (2013.01); *C11D 1/72* (2013.01)
USPC ..... 510/421; 510/360; 510/433; 510/475; 510/499; 510/504; 510/505; 510/535

(58) Field of Classification Search
USPC ..... 510/360, 421, 433, 475, 499, 504, 505, 510/535
See application file for complete search history.

(56) References Cited

U.S. PATENT DOCUMENTS 4,597,889 A 7/1986 Jones et al.
4,610,799 A 9/1986 Wilsberg et al.
(Continued)

FOREIGN PATENT DOCUMENTS

EP 128231 * 12/1984 ..... C11D 3/00
EP 0128231 A1 12/1984
(Continued)

OTHER PUBLICATIONS

English language abstract for JP 1132691 extracted from espacenet.com database on Feb. 28, 2013, 9 pages.
(Continued)

*Primary Examiner* — Brian P Mruk
(74) *Attorney, Agent, or Firm* — Howard & Howard Attorneys PLLC

(57) ABSTRACT

A surfactant component and a composition comprising the same are provided. The surfactant component comprises a first surfactant, a second surfactant, and water. The first surfactant comprises an alcohol alkoxylate having a high degree of alkoxylation of greater than 30 to 150. The first surfactant is present in an amount of from 1% to 50% by weight based on the total weight of the surfactant component. The second surfactant is present in an amount of at least 5% by weight based on the total weight of the surfactant component. Water is present in an amount of from 20% to 90% by weight based on the total weight of the surfactant component. The second surfactant enables higher concentrations of the first surfactant in water to be achieved without gelling than what has been accomplished to date.

27 Claims, 14 Drawing Sheets

(56) References Cited

U.S. PATENT DOCUMENTS

| | | | | |
|---|---|---|---|---|
| 4,931,063 | A | 6/1990 | Wilsberg et al. | |
| 4,975,218 | A | 12/1990 | Rosser | |
| 5,018,337 | A | 5/1991 | Carter et al. | |
| 5,021,507 | A | 6/1991 | Stanley et al. | |
| 5,215,683 | A | 6/1993 | Kravetz et al. | |
| 5,474,713 | A | 12/1995 | Faber | |
| 5,536,438 | A | 7/1996 | Scialla et al. | |
| 5,545,350 | A | 8/1996 | Baker et al. | |
| 5,863,878 | A | 1/1999 | Carr et al. | |
| 6,057,285 | A | 5/2000 | Pescador et al. | |
| 6,133,218 | A | 10/2000 | Kerobo et al. | |
| 6,271,191 | B1 | 8/2001 | Kerobo et al. | |
| 6,492,317 | B1 | 12/2002 | Kerobo et al. | |
| 6,559,112 | B2 | 5/2003 | Fox et al. | |
| 7,503,333 | B2 | 3/2009 | Dailey et al. | |
| 7,504,373 | B2 | 3/2009 | Dailey et al. | |
| 2005/0170991 | A1 * | 8/2005 | Ruland et al. | 510/421 |
| 2009/0023820 | A1 | 1/2009 | Dailey et al. | |

FOREIGN PATENT DOCUMENTS

| | | | | | |
|---|---|---|---|---|---|
| EP | 0503221 | A1 | | 9/1992 | |
| EP | 0561103 | A1 | | 9/1993 | |
| EP | 598335 | | * | 5/1994 | C11D 17/00 |
| EP | 0598335 | A2 | | 5/1994 | |
| EP | 0651049 | A2 | | 5/1995 | |
| JP | 1132691 | A | | 5/1989 | |
| JP | 10-130693 | A | | 5/1998 | |
| JP | 2003534447 | A | | 11/2003 | |
| WO | WO 93/23510 | A1 | | 11/1993 | |

OTHER PUBLICATIONS

English language abstract and translation for JP 10-130693 extracted from PAJ database on Sep. 6, 2011, 29 pages.

English language abstract not found for JP 2003534447. However see English language equivalent US 6,492,317. Original document extracted from espacenet.com database on Apr. 18, 2013, 21 pages.

International Search Report for Application No. PCT/US2011/039984 dated Sep. 7, 2011, 4 pages.

* cited by examiner

SURFACTANT COMPONENT AND A COMPOSITION INCLUDING THE SAME

RELATED APPLICATIONS

This application is the National Stage of International Patent Application No. PCT/US2011/039984, filed on Jun. 10, 2011, which claims priority to and all the advantages of U.S. Provisional Patent Application No. 61/356,791, filed on Jun. 21, 2010, the content of which is incorporated herein by reference.

BACKGROUND OF THE INVENTION

1. Field of the Invention

The present invention generally relates to a surfactant component and a composition including the same. More specifically, the present invention relates to a surfactant component including a first surfactant, a second surfactant, and water.

2. Description of the Related Art

Generally, consumers prefer textiles that appeal to their somatic senses (e.g. touch) with a desirable degree of softness. Often, laundering reduces the softness of textiles such that consumers may perceive laundered textiles as rough or scratchy. Compositions including fabric softeners/conditioners are often used during laundering to preserve the softness of the laundered textiles. Contemporary fabric softeners/conditioners may include water insoluble components including cationic active ingredients for preserving the softness of the laundered textiles. Water insoluble components, as referred to herein, generally have a water solubility of less than or equal to 1000 ppm at 25° Celsius.

A common problem associated with the use of water insoluble components is their poor dispersion in and tendency to separate out of water, even at low concentrations. Poor dispersion in and separation of the water insoluble components out of water greatly reduces uniform dispersion and deposition of the water insoluble components on laundered textiles. Reduced dispersion and deposition of the water insoluble components on laundered textiles results in ineffective preservation of the softness of the textiles. Therefore, use of water insoluble components in compositions is traditionally limited to low concentrations, which is not suitable for effectively preserving the softness of the laundered textiles as desired. Further, low concentrations of water insoluble components in compositions increases overall shipping costs as the compositions must be heavily diluted with water.

A number of approaches have been developed in an effort to improve dispersion of water insoluble components in compositions. One approach is to add a surfactant component comprising a surfactant and water to the compositions. The surfactant may include alcohol alkoxylates. Particularly suitable alcohol alkoxylates include those that have a high degree of alkoxylation. However, alcohol alkoxylates, and especially alcohol alkoxylates having a high degree of ethoxylation, have a tendency to gel in water even at low concentrations. Gelling of the surfactant component is undesirable as gelling also requires heavily diluting the surfactant with water, which increases overall shipping costs. Additionally, gelling of the surfactant component further inhibits adequate dispersion of the water insoluble components in the composition.

Additional processes are often necessary to ensure that the surfactant component remains a flowable liquid, and to further ensure that the water insoluble component is adequately dispersed in the composition. One approach to prevent gelling of the surfactant component requires long periods of mixing to dissolve the alcohol alkoxylates in water. Such long periods of mixing are only moderately effective at preventing gelling and slow production of the surfactant component while increasing production costs. Regardless of how long the surfactant component is mixed, alcohol alkoxylates having a high degree of alkoxylation greater than 30 moles of ethylene oxide per molecule will typically gel when present in an amount in excess of 15% by weight based on the total weight of the surfactant component.

It is known in the art that gelling of alcohol alkoxylates having a low degree of alkoxylation in water can be decreased by incorporating an additive with the alcohol alkoxylate. For example, alcohol alkoxylates having from 1 to 25 moles of alkylene oxide have been combined with alcohol alkoxysulfates to decrease gelling of the alcohol alkoylates in water. Additionally, alcohol alkoxylates having from 3 to 10 moles of alkylene oxide have been combined with polyhydric alcohol to decrease gelling of the alcohol alkoxylates in water. In another example, an alcohol alkoxylate having from 3 to 30 moles of alkylene oxide is combined with a different alcohol alkoxylate having from 3 to 30 moles of alkylene oxide. However, such approaches have only involved alcohol alkoxylates having a low degree of alkoxylation of 30 moles or less of alkylene oxide per molecule, and such alcohol alkoxylates having a low degree of alkoxylation are insufficiently effective for dispersing water insoluble components in water. Further, it is not known if incorporating additives into the surfactant component can interfere with or compromise performance of alcohol alkoxylates having a high degree of alkoxylation in dispersing water insoluble components.

In view of the foregoing, there remains an opportunity to provide a surfactant component including water and an alcohol alkoxylate having a high degree of alkoxylation of greater than 30 moles of alkylene oxide per molecule and that resists gelling and that exhibits excellent performance in dispersing water insoluble components in water.

SUMMARY OF THE INVENTION AND ADVANTAGES

The present invention provides a surfactant component and a composition including the same. The surfactant component includes a first surfactant, a second surfactant, and water. The first surfactant is represented by the general formula: $R^1$—O-$(A)_m$H wherein $R^1$ is a hydrocarbon group having from 14 to 22 carbon atoms, A is an alkyleneoxy group having from 2 to 4 carbon atoms, and m is greater than 30 to 150. The first surfactant is present in an amount of from 1% to 50% by weight based on the total weight of the surfactant component. The second surfactant is represented by the general formula: $R^2$—O—$(B)_n$—H wherein $R^2$ is a hydrocarbon group having from 6 to 14 carbon atoms, B is an alkyleneoxy group having from 2 to 4 carbon atoms, and n is from 3 to 20. The second surfactant is present in an amount of at least 5% by weight based on the total weight of the surfactant component. Water is present in an amount of from 20% to 90% by weight based on the total weight of the surfactant component.

The surfactant component resists gelling at high concentrations of the first surfactant in water and exhibits increased dispersibility/solubility/miscibility of the first surfactant in water as compared to when the first surfactant is present in water in the absence of the second surfactant. Use of the specific second surfactant therefore alleviates a need for additional processes to reduce viscosity. Further, because high concentrations of the first surfactant in the surfactant component can be attained without gelling when the second surfactant is present use of the second surfactant directly reduces manufacturing and shipping costs of the surfactant component because less water is required to be present in the surfactant component to avoid gelling thereof. Due to the presence of the second surfactant along with the first surfactant in the above described amounts, the surfactant component also exhibits excellent dispersion of water insoluble components.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
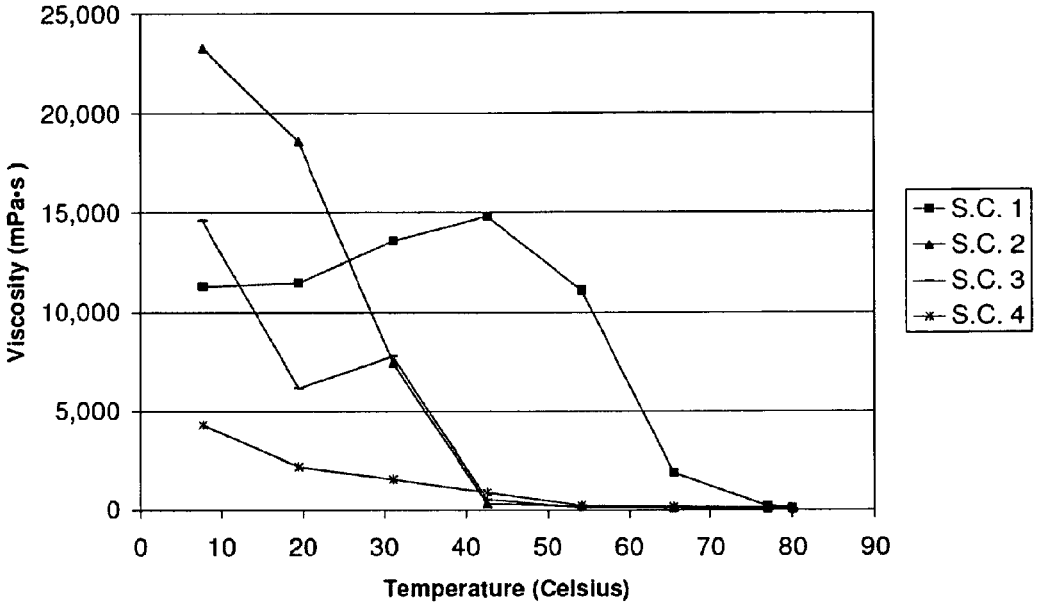
FIG. 1 is a line graph illustrating viscosity over a temperature range of from 8° to 80° Celsius of a first embodiment, a second embodiment, a third embodiment, and a fourth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 2:
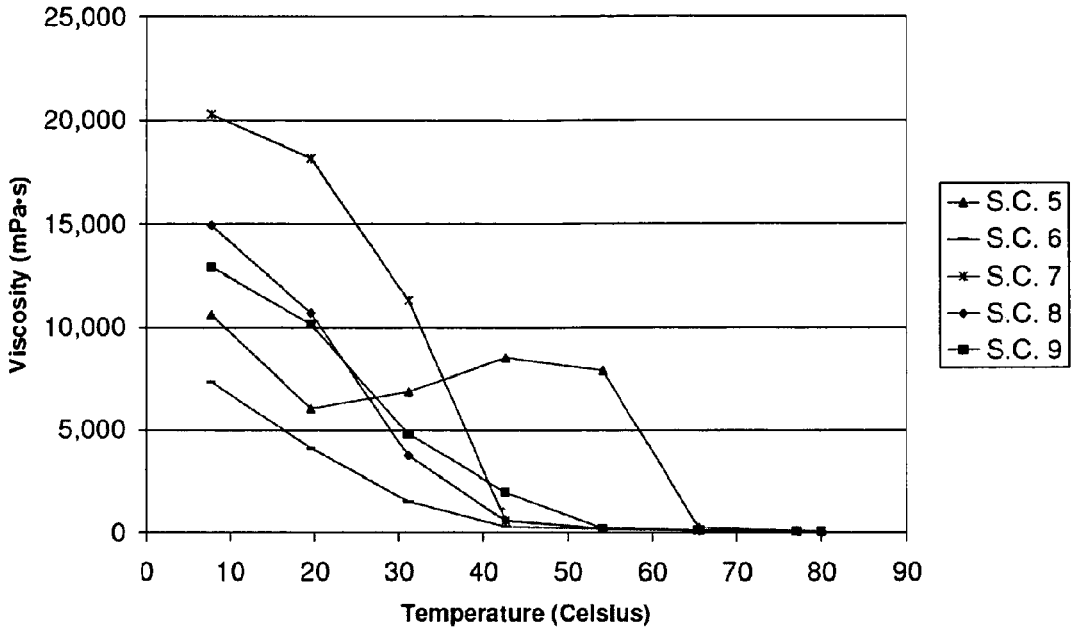
FIG. 2 is a line graph illustrating viscosity over a temperature range of from 8° to 80° Celsius of a fifth embodiment, a sixth embodiment, a seventh embodiment, an eight embodiment, and a ninth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 3:
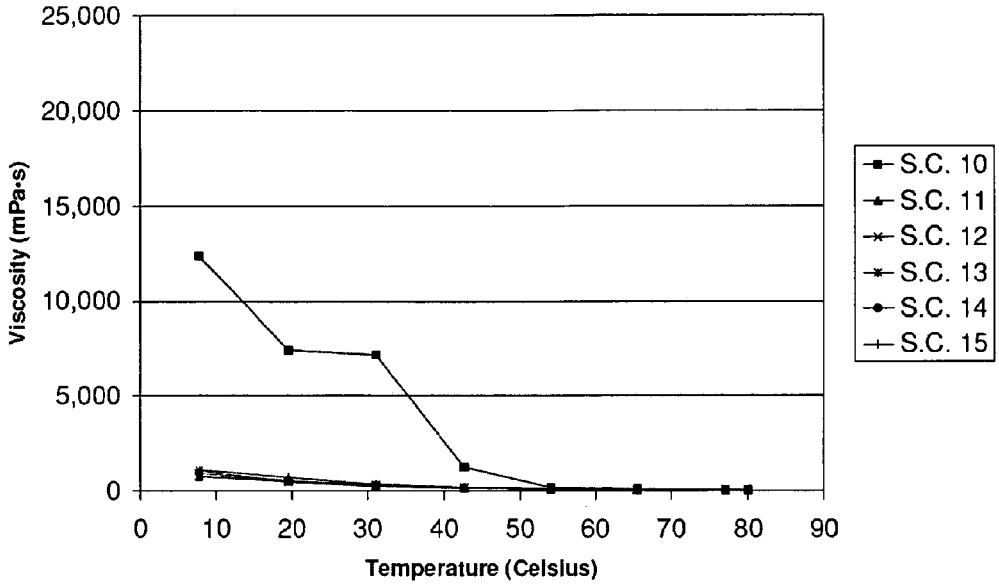
FIG. 3 is a line graph illustrating viscosity over a temperature range of from 8° to 80° Celsius of a tenth embodiment, an eleventh embodiment, a twelfth embodiment, a thirteenth embodiment, a fourteenth embodiment, and a fifteenth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 4:
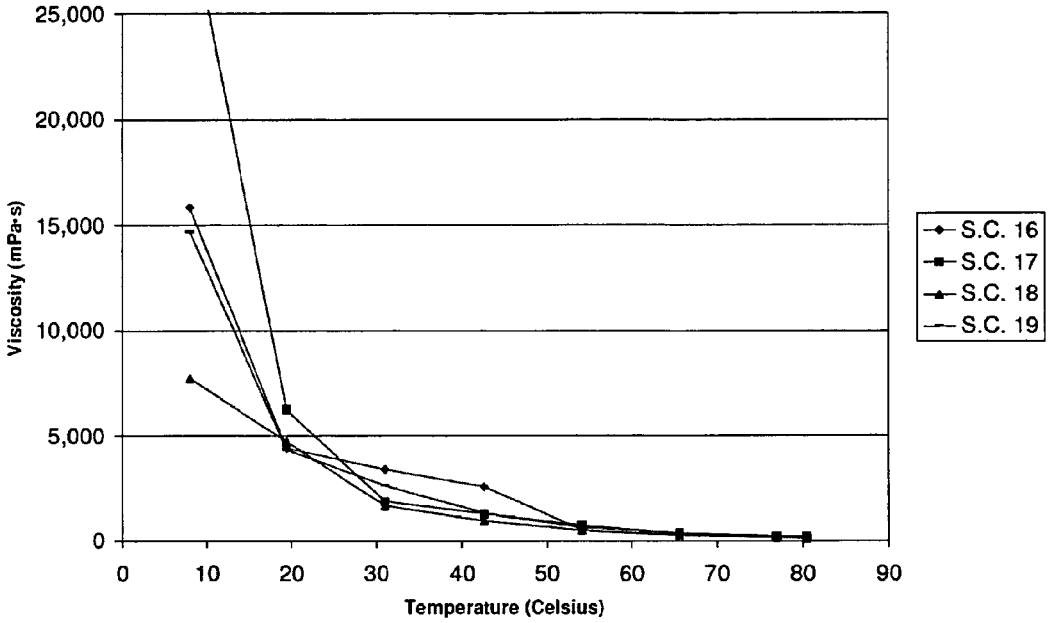
FIG. 4 is a line graph illustrating viscosity over a temperature range of from 8° to 80° Celsius of a sixteenth embodiment, a seventeenth embodiment, a eighteenth embodiment, and a nineteenth embodiment of a surfactant component, wherein each surfactant component comprises a first surfactant present in an amount of 50% by weight, a second surfactant present in an amount of 10% by weight, and water present in an amount of 40% by weight, all based on the total weight of the surfactant component.
Figure 5:
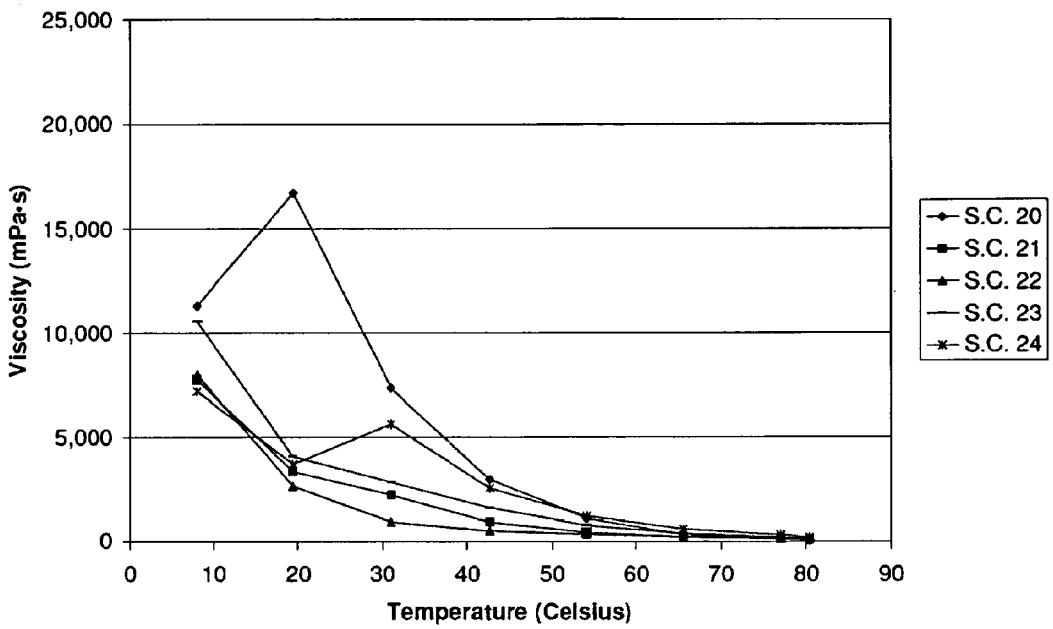
FIG. 5 is a line graph illustrating viscosity over a temperature range of from 8° to 80° Celsius of a twentieth embodiment, a twenty-first embodiment, a twenty-second embodiment, a twenty-third embodiment, and a twenty-forth embodiment of a surfactant component, wherein each surfactant component comprises a first surfactant present in an amount of 50% by weight, a second surfactant present in an amount of 10% by weight, and water present in an amount of 40% by weight, all based on the total weight of the surfactant component.
Figure 6:
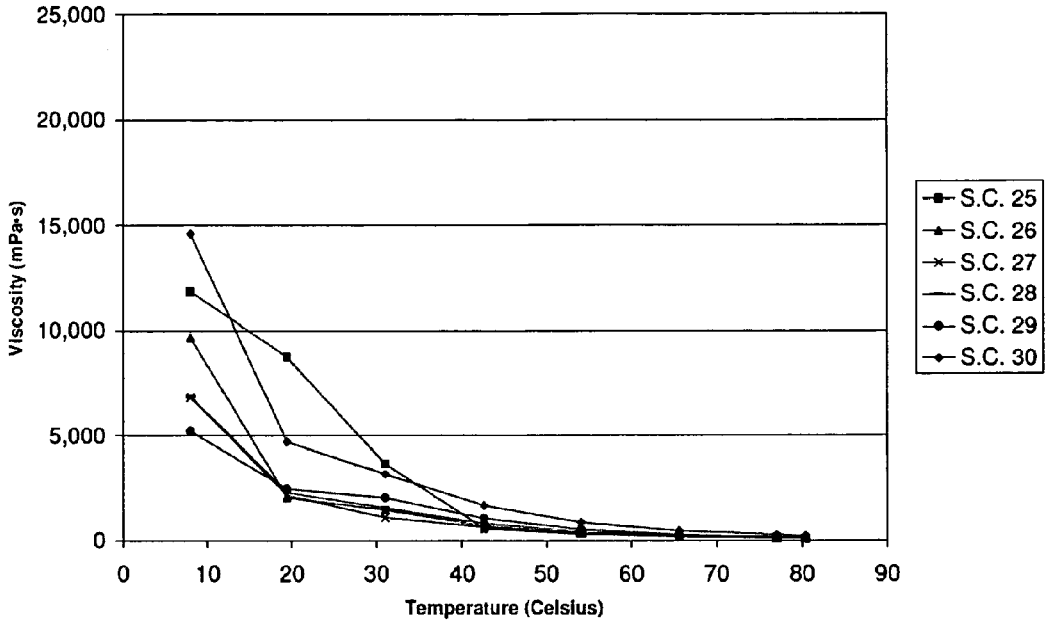
FIG. 6 is a line graph illustrating viscosity over a temperature range of from 8° to 80° Celsius of a twenty-fifth embodiment, a twenty-sixth embodiment, a twenty-seventh embodiment, a twenty-eighth embodiment, a twenty-ninth embodiment, and a thirtieth embodiment of a surfactant component, wherein each surfactant component comprises a first surfactant present in an amount of 50% by weight, a second surfactant present in an amount of 10% by weight, and water present in an amount of 40% by weight, all based on the total weight of the surfactant component.
Figure 7:
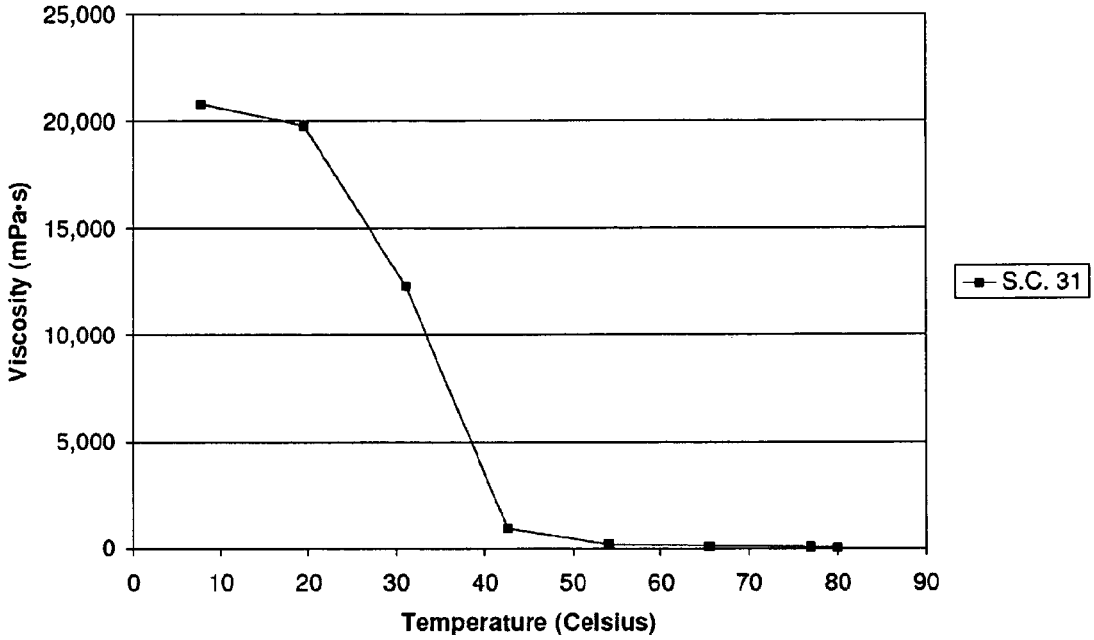
FIG. 7 is a line graph illustrating viscosity over a temperature range of from 8° to 80° Celsius of a thirty-first embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 8:
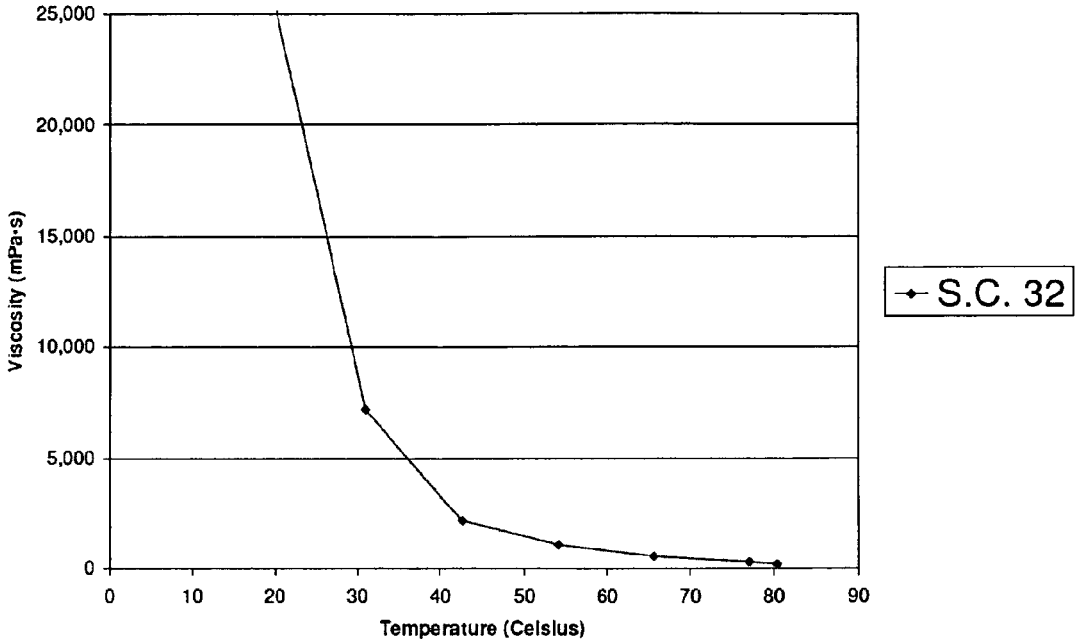
FIG. 8 is a line graph illustrating viscosity over a temperature range of from 8° to 80° Celsius of a thirty-second embodiment of a surfactant component, wherein each surfactant component comprises a first surfactant present in an amount of 50% by weight, a second surfactant present in an amount of 10% by weight, and water present in an amount of 40% by weight, all based on the total weight of the surfactant component.
Figure 9:
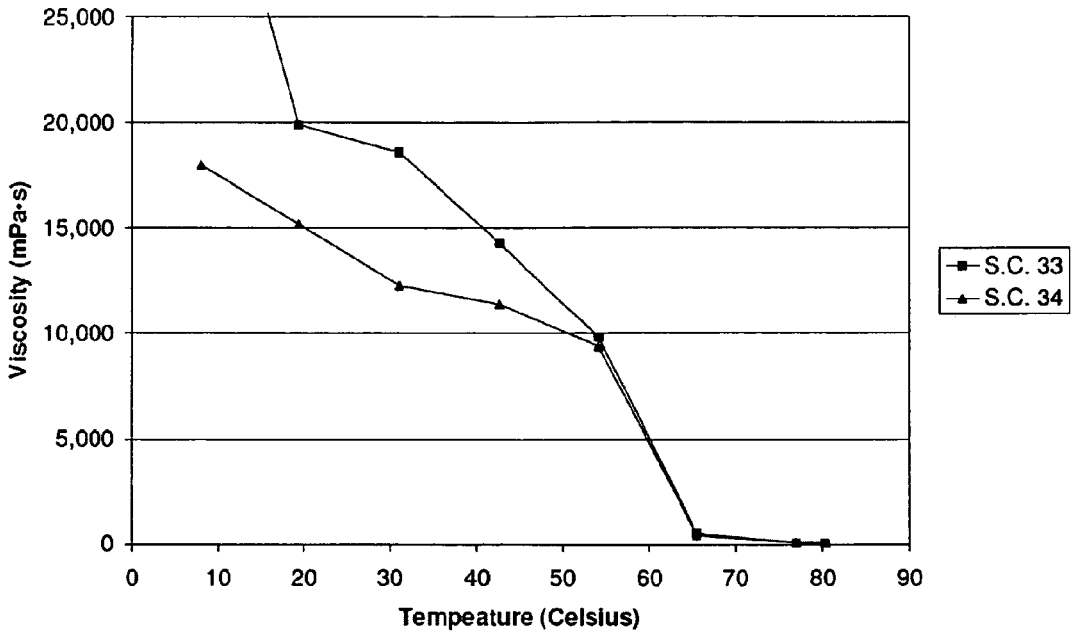
FIG. 9 is a line graph illustrating viscosity over a temperature range of from 8° to 80° Celsius of a thirty-third embodiment and a thirty-fourth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 10:
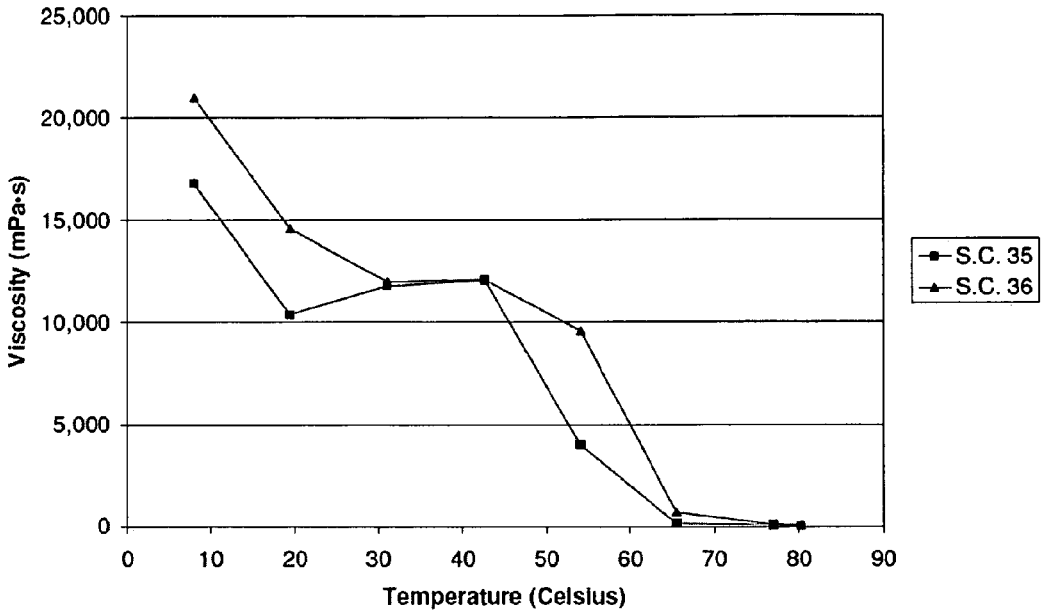
FIG. 10 is a line graph illustrating viscosity over a temperature range of from 8° to 80° Celsius of a thirty-fifth embodiment and a thirty-sixth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 11:
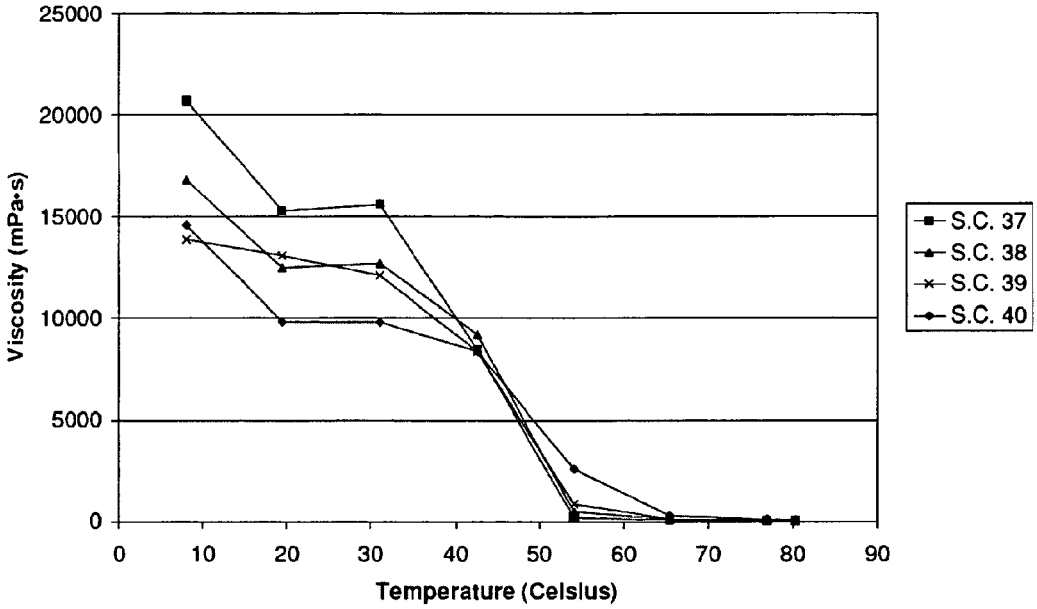
FIG. 11 is a line graph illustrating viscosity over a temperature range of from 8° to 80° Celsius of a thirty-seventh embodiment, a thirty-eighth embodiment, a thirty-ninth, and a fortieth embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.
Figure 12:
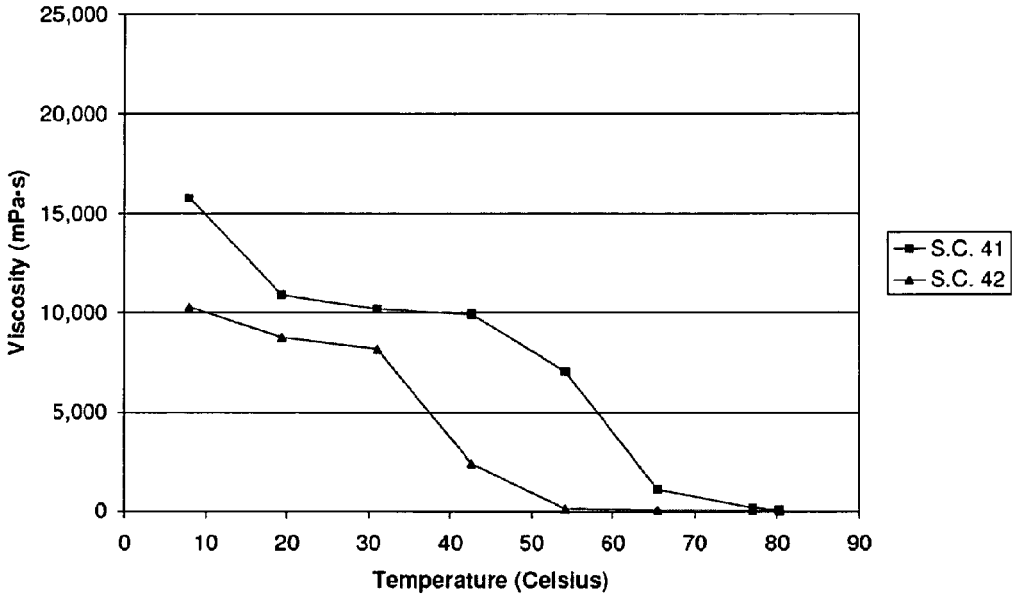
FIG. 12 is a line graph illustrating viscosity over a temperature range of from 8° to 80° Celsius of a forty-first embodiment and a forty-second embodiment of a surfactant component, wherein each surfactant component comprises a first surfactant present in an amount of 25% by weight, a second surfactant present in an amount of 5% by weight, and water present in an amount of 70% by weight, all based on the total weight of the surfactant component.

A surfactant component, a composition including the same, and a method of forming the composition are provided.

The composition may be used in textile laundering and includes a water insoluble component. The water insoluble component is included in the composition for various purposes. In one embodiment, the water insoluble component preserves softness of textiles. In this embodiment, the composition is used independently as a fabric conditioner. Textiles that may benefit from laundering with the composition of the present invention may include cloth and/or yarn and may be formed from, but are not limited to, polyester, cotton, nylon, wool, silk, and combinations thereof.

The water insoluble component may include, but is not limited to, cationic active ingredients, fatty acids, monomers for emulsion polymerization, solids suspended in water, and waxes including paraffin and ester-type waxes. In one embodiment, the water insoluble component comprises a cationic active ingredient. The cationic active ingredient may include, but is not limited to, quaternary ammonium salts, compounds derived from imidazolium, substituted amine salts, quaternary alkoxy ammonium salts, and combinations thereof. Typically, the water insoluble component has a water solubility of less than or equal to 1000 ppm at 25° Celsius, alternatively less than or equal to 500 ppm at 25° Celsius, and alternatively less than or equal to 100 ppm at 25° Celsius. The water insoluble component is typically present in the composition in an amount of from 0.5% to 50% by weight based on the total weight of the composition.

The composition also includes water; however the water insoluble component may have a tendency to separate from water even at low concentrations. The surfactant component is added to the composition to disperse the water insoluble component in the composition, thereby at least partially inhibiting the separation of the water insoluble component from the water in the composition when high concentrations of the water insoluble component are present and enhancing uniform deposition of the water insoluble component on the textiles when the composition is used as a fabric conditioner. The surfactant component includes water and a first surfactant having a degree of alkoxylation of greater than 30 to 150. Surfactants having such a high degree of alkoxylation, particularly a high degree of ethoxylation, exhibit excellent performance in dispersing water insoluble components in water, but have a tendency to gel in water even at low concentrations. The surfactant component provided herein also includes a second surfactant that effectively inhibits the first surfactant from gelling in the water. Due to the presence of the second surfactant, the surfactant component remains flowable and can support high concentrations of the first surfactant. Accordingly, the surfactant component does not require heavy dilution with water to prevent gelling. Therefore, shipping costs of the surfactant component are significantly reduced. Additionally, high concentrations of the first surfactant are desirable for preparing the composition. More specifically, high concentrations of the first surfactant in the surfactant component allow the composition including the same to effectively support and disperse higher concentrations of the water insoluble component in the composition than have been possible to date.

The first surfactant has the general formula $R^1$—O-$(A)_m$H. In the general formula of the first surfactant, $R^1$ is a hydrocarbon group having from 14 to 22 carbon atoms. As is known in the art, hydrocarbon groups may include straight, branched, and/or cyclic chains of carbon and hydrogen atoms which may be saturated or unsaturated. However, the hydrocarbon group is typically a straight chain hydrocarbon group. Additionally, A in the general formula for the first surfactant is an alkyleneoxy group having from 2 to 4 carbon atoms. Suitable alkyleneoxy groups include ethyleneoxy groups (2 carbon atoms), propyleneoxy groups (3 carbon atoms), butyleneoxy groups (4 carbon atoms), and combinations thereof. Most preferably, A is an ethyleneoxy group. Typically, ethyleneoxy groups are present in an amount at least 75%, more typically at least 90%, and most typically at least 95% of all alkyleneoxy groups present in the first surfactant. The variable m represents a number of alkyleneoxy groups present in the first surfactant and has a value of from greater than 30 to 150, alternatively from 40 to 150, alternatively from 55 to 120, and alternatively from 70 to 100. The first surfactant is preferably present in the surfactant component in an amount of from 1% to 50%, alternatively from 12% to 50%, and alternatively from 25% to 50% by weight based on the total weight of the surfactant component.

Without being limited to any theory, it is believed that the first surfactant having a high degree of alkoxylation of greater than 30 moles of alkylene oxide and preferably greater than 30 moles of ethylene oxide, in part, provides for excellent dispersion of water insoluble components, therefore enhancing uniform deposition of the water insoluble components on the textiles. Also, it is believed that the high degree of alkoxylation enables the first surfactant to interact with and disperse the water insoluble component in the composition, therefore at least partially inhibiting the water insoluble component from separating out of the water in the composition. Accordingly, it is believed that a higher concentration of the first surfactant in the surfactant component, and therefore the composition, provides increased dispersion of the water insoluble component in the composition. Due to the increased dispersion, the water insoluble component may be included in the composition with adequate dispersion thereof and at high concentrations without heavy dilution with water.

In one embodiment, the first surfactant may be produced by alkoxylating a first alcohol having from 14 to 22 carbon atoms with an alkylene oxide in the presence of a catalyst and water. The first alcohol may include any alcohol having from 14 to 22 carbon atoms. In one embodiment the first alcohol includes a mixture of different alcohols independently having from 14 to 22 carbon atoms. Alternatively, the first alcohol may include a single type of alcohol having from 14 to 22 carbon atoms.

As alluded to above, the composition also includes the second surfactant having the general formula $R^2$—O—$(B)_n$—H. In the general formula of the second surfactant, $R^2$ is a hydrocarbon group having from 6 to 14 carbon atoms. It is contemplated that the hydrocarbon group having from 6 to 14 carbon atoms may be branched, and may particularly be formed from a Guerbet alcohol as described below. In one embodiment, $R^2$ is a hydrocarbon group having 10 carbon atoms. An example of a suitable hydrocarbon group having 10 carbon atoms includes, but is not limited to, a 2-propylheptane moiety. It is to be understood that the terminology "2-propylheptane moiety" refers to a $C_{10}H_{22}$ moiety bonded to the oxygen atom in the general formula of the second surfactant. For descriptive purposes only, a chemical structure of the 2-propylheptane moiety is shown below:

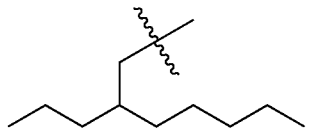

Additionally, B in the general formula for the second surfactant is an alkyleneoxy group having from 2 to 4 carbon atoms. Most preferably, B is further defined as an ethyleneoxy group. Further, the variable n represents a number of alkyleneoxy groups present in the second surfactant and has a value of from 3 to 20, alternatively from 6 to 14. It is contemplated that, when a combination of different alkyleneoxy groups is present in the second surfactant, the alkyleneoxy groups may be distributed randomly or blockwise. The second surfactant is preferably present in the surfactant component in an amount of at least 5% by weight based on the total weight of the surfactant component. In one embodiment, the second surfactant is present in the surfactant component in an amount of less than or equal to 20% by weight, and alternatively less than or equal to 10% by weight, both based on the total weight of the surfactant component.

In one embodiment, the second surfactant may be produced in the same manner in which the first surfactant is produced, i.e., by alkoxylating a second alcohol having from 6 to 14 carbon atoms with an alkylene oxide in the presence of a catalyst and water.

The second alcohol may include any alcohol having from 6 to 14 carbon atoms. In one embodiment, the second alcohol includes a mixture of different alcohols independently having from 6 to 14 carbon atoms. Alternatively, the second alcohol may include a single type of alcohol having from 6 to 14 carbon atoms. As alluded to above, the second alcohol can be a Guerbet alcohol. Preferably, the second alcohol has 10 carbon atoms and includes 2-propylheptanol. For descriptive purposes only, a chemical structure of 2-propylheptanol is shown below:

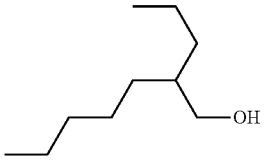

2-propylheptanol

Typically, the step of alkoxylating the first alcohol is completed separately from the step of alkoxylating the second alcohol. Process conditions for producing alcohol alkoxylates are generally known in the art.

As set forth above, the first surfactant disperses water insoluble components, therefore enhancing uniform deposition of the water insoluble components on textiles and inhibiting separation of water insoluble components, including high concentrations of water insoluble components, from water in the composition. Accordingly it is desirable to use surfactant components having a high concentration of the first surfactant in compositions having high concentrations of water insoluble components. The second surfactant inhibits gelling of the high concentration of the first surfactant in water in the surfactant component that would otherwise gel in the absence of the second surfactant. Typically, the second surfactant is included in the surfactant component in an amount sufficient to inhibit gelling of the first surfactant in the surfactant component and also in a sufficiently low amount so as to avoid interfering with the overall benefits of the first surfactant. The amounts of the second surfactant present in the surfactant component set forth above satisfy the aforementioned goals.

The surfactant component also includes water. Water is present in the surfactant component in an amount of from 20% to 90% by weight alternatively from 30% to 80% by weight, and alternatively from 40% to 70% by weight based on the total weight of the surfactant component. The surfactant component of the present invention supports high concentrations of the first surfactant therefore minimizing the water present in the surfactant component and significantly reducing overall shipping costs of the surfactant component.

In one embodiment, the surfactant component includes the first surfactant present in an amount of from 1% to 50% by weight based on the total weight of the surfactant component, the second surfactant present in amount of at least 5% by weight based on the total weight of the surfactant component, and water present in an amount of from 20% to 90% by weight based on the total weight of the surfactant component. In another embodiment, the surfactant component includes the first surfactant present in amount of from 25% to 50% by weight based on the total weight of the surfactant component, the second surfactant present in amount of from 5% to 10% by weight based on the total weight of the surfactant component, and water present in amount of from 40% to 70% by weight based on the total weight of the surfactant component. It is contemplated that the surfactant component has a viscosity of less than 4,000 mPa·s at 40° Celsius, alternatively less than 4,000 mPa·s at 25° Celsius, and alternatively less than 1,500 mPa·s at 25° Celsius.

The surfactant component as set forth above resists gelling and disperses the water insoluble component therefore inhibiting high concentrations of the water insoluble component from separating out of the water in the composition. Without being limited to any theory, it is believed that the second surfactant has structure-breaking properties, which result in inhibition of gelling that may otherwise occur with the first surfactant in water. The structure-breaking properties of the second surfactant enable the second surfactant to disperse and prevent gelling of the first surfactant in the water while at the same time, the first surfactant having the high degree of alkoxylation, and preferably ethoxylation, provides excellent dispersion of and at least partially inhibits the water insoluble component from separating out of the water in the composition without interference from the second surfactant. The excellent dispersive qualities of the first and second surfactants are especially realized at high concentrations of the first surfactant that would otherwise result in gelling of the surfactant component in the absence of the second surfactant and at high concentrations of the water insoluble component in the composition that would otherwise fail to uniformly deposit on the textiles or separate out of the composition in the absence of the first surfactant. Due to the unexpected interaction between the first and second surfactants, additional processes are no longer necessary to ensure that the surfactant component remains a flowable liquid. Additionally, the unexpected interaction results in a significant reduction in water in both the surfactant component and the composition, therefore reducing manufacturing, shipping, and ultimately purchasing costs for an end user.

Various methods of forming the surfactant component will now be described. In one embodiment, a full amount of the water is charged with a first amount of the first surfactant into a vessel to form a mixture. The step of charging the full amount of the water with the first amount of the first surfactant, rather than a full amount of the first surfactant, prevents gelling of the mixture. The first amount of the first surfactant is typically sufficiently low to avoid gelling of the mixture, e.g., the first surfactant may be charged in an amount of 12% by weight based on the total weight of the mixture, while the full amount of the water present in the vessel is sufficient to dilute the first surfactant at this point in the method. The first surfactant may optionally be ground and/or heated before the water is charged with the first amount of the first surfactant.

Next, the mixture is spiked with a full amount of the second surfactant, e.g., 5% by weight based on the total weight of the surfactant component. The step of spiking the mixture with the second surfactant prevents gelling when additional amounts of the first surfactant are subsequently added that would otherwise result in gelling of the mixture in the absence of the second surfactant. Additional amounts of the first surfactant may then be subsequently added to the mixture. For example, after one or more subsequent additions, the first surfactant may be present in a desired concentration of 25% by weight based on the total weight of the mixture. Once the mixture includes the desired concentration of the first surfactant, the mixture is referred to as the surfactant component.

In another embodiment, a full amount of the water is charged with a full amount of the second surfactant into a vessel to form a mixture. A full amount of the first surfactant is then combined with the mixture to form the surfactant component.

In yet another embodiment, the surfactant mixture is formed by mixing a full amount of the first surfactant and a full amount of the second surfactant. Next, a full amount of the water is mixed with the surfactant mixture to form the surfactant component. Alternatively, a full amount of the first surfactant, a full amount of the second surfactant, and a full amount of the water are mixed simultaneously to form the surfactant component.

The composition comprises the first surfactant, the second surfactant, water, and the water insoluble component. The first surfactant is as described above and is typically present in the composition an amount of from 0.1% to 5% by weight based on the total weight of the composition. The second surfactant is as described above and is typically present in an amount of from 0.02% to 1% by weight based on the total weight of the composition. Water is typically present in an amount of from 40% to 80% by weight based on the total weight of the composition. As set forth above, the water insoluble component is present in an amount of from 0.5% to 50%, alternatively from 5% to 50%, alternatively from 15% to 40%. Also as set forth above, the surfactant component supports high concentrations of the first surfactant in water. Further, the high concentration of the first surfactant, in turn, supports high concentrations of the water insoluble component in the composition without requiring heavy dilution with water. Reducing the water present in the composition significantly reduces shipping costs associated with the composition.

In addition to the first surfactant, the second surfactant, water, and the water insoluble component, the composition may also include, but does not require, additional components such as additional surfactants that are different from the first and second surfactants, solvents, salts, graying inhibitors, soil release polymers, color transfer inhibitors, foam inhibitors, complexing agents, optical brighteners, fragrances, fillers, formulation auxiliaries, solubility improvers, opacifiers, dyes, corrosion inhibitors, electrolytes, water, chelating agents, polymers, perfumes, oils, enzymes, and combinations thereof. Further, it is to be appreciated that the additional surfactants can include by-products of production of the first and second surfactants. However, the by-products are typically present in the composition in an amount of less than 11% by weight, alternatively less than 5% by weight, and alternatively less than 2% by weight based on the total weight of the first and second surfactants. When included, the additional components are typically present in an amount of less than 10% by weight based on the total weight of the composition.

The composition as set forth above resists gelling and contains higher concentrations of the water insoluble component in water than have previously been achieved while minimizing separation of the water insoluble component from the composition.

The present invention also provides a method of forming the composition. For the method, in one embodiment, the first surfactant may be provided in a first surfactant component comprising at least 89% by weight, alternatively at least 95% by weight, alternatively at least 98% by weight, and alternatively 100% by weight, of the first surfactant based on the total weight of the first surfactant component. In this embodiment, the second surfactant may be provided in a second surfactant component comprising at least 89% by weight, alternatively at least 95% by weight, alternatively at least 98% by weight, and alternatively 100% by weight, of the second surfactant based on the total weight of the second surfactant component. In both the first and second surfactant components the balance of the respective surfactant components, excluding the first and second surfactants, respectively, may be the by-products described above. In one embodiment, the first surfactant component, the second surfactant component, and water are mixed to first form the surfactant component before being mixed with the water insoluble component to form the composition. However, it is to be appreciated that the first surfactant component, the second surfactant component, water, the water insoluble component, and the additional components may be mixed in any order to form the composition.

The following examples are meant to illustrate the invention and are not to be viewed in any way as limiting to the scope of the invention.

EXAMPLES

A series of surfactant components (Surfactant Components 1-42) are formed as described above by combining a first surfactant, a second surfactant, and deionized water.

Specifically, Surfactant Components 1-42 are formed by combining a full amount of the first surfactant component, a full amount of the second surfactant component, and a full amount of the deionized water in a vessel. The first surfactant component includes the first surfactant in an amount of at least 95% by weight based on the total weight of the first surfactant component. The second surfactant component includes the second surfactant in an amount of at least 95% by weight based on the total weight of the second surfactant component. The contents of the vessel are heated to a temperature from about 50° Celsius to about 70° Celsius and mixed until the contents of the vessel are homogenous. Comparative Surfactant Components 1-4 are not formed according to the subject invention, but is formed by combining a full amount of the first surfactant component and a full amount of the deionized water in a vessel. The contents of the vessel are heated to a temperature from about 50° Celsius to about 70° Celsius and mixed until the contents of the vessel are homogenous. Chemical descriptions of the first and second surfactant components used to form Surfactant Components 1-42 and Comparative Surfactant Components 1-4 are provided below.

A viscosity/temperature profile is generated for Surfactant Components 1-42 and Comparative Surfactant Components 1-4 using an Anton Paar Physica Rheometer (model MCR 301) using a PP50 measuring plate. The viscosity/temperature profiles for Surfactant Components 1-42 and Comparative Surfactant Components 1 and 3 are provided in FIGS. 1-14.

Tables 1-4 provide specific data relative to the exact composition of Surfactant Components 1-42 and Comparative Surfactant Component 1-4. Table 1 provides data relative to the specific first surfactant component and the second surfactant component, each described in greater detail below, that are mixed to form the Surfactant Components 1-42. Table 2 provides amounts of the first surfactant component, the second surfactant component, and water, listed as percent by weight based on the total weight of each of the Surfactant Components 1-42. Table 3 provides data relative to the first surfactant component used in the Comparative Surfactant Components 1-4. Table 4 provides amounts of the first surfactant component and water, listed as percent by weight based on the total weight of each of the Comparative Surfactant Components 1-4.

TABLE 1

| Surfactant Component | First Surfactant Component | Second Surfactant Component |
|---|---|---|
| 1 | 1 | 1 |
| 2 | 1 | 2 |
| 3 | 1 | 3 |
| 4 | 1 | 4 |
| 5 | 1 | 5 |
| 6 | 1 | 6 |
| 7 | 1 | 7 |
| 8 | 1 | 8 |
| 9 | 1 | 9 |
| 10 | 1 | 10 |
| 11 | 1 | 11 |
| 12 | 1 | 12 |
| 13 | 1 | 13 |
| 14 | 1 | 14 |
| 15 | 1 | 15 |
| 16 | 1 | 1 |
| 17 | 1 | 2 |
| 18 | 1 | 3 |
| 19 | 1 | 4 |
| 20 | 1 | 5 |
| 21 | 1 | 6 |
| 22 | 1 | 7 |
| 23 | 1 | 8 |
| 24 | 1 | 9 |
| 25 | 1 | 10 |
| 26 | 1 | 11 |
| 27 | 1 | 12 |
| 28 | 1 | 13 |
| 29 | 1 | 14 |
| 30 | 1 | 15 |
| 31 | 1 | 16 |
| 32 | 1 | 16 |
| 33 | 2 | 1 |
| 34 | 2 | 4 |
| 35 | 2 | 6 |
| 36 | 2 | 8 |
| 37 | 2 | 10 |
| 38 | 2 | 11 |
| 39 | 2 | 13 |
| 40 | 2 | 15 |
| 41 | 2 | 16 |
| 42 | 2 | 17 |

TABLE 2

| Surfactant Component | First Surfactant Component | Second Surfactant Component | Water |
|---|---|---|---|
| 1 | 25% | 5% | 70% |
| 2 | 25% | 5% | 70% |
| 3 | 25% | 5% | 70% |
| 4 | 25% | 5% | 70% |
| 5 | 25% | 5% | 70% |

TABLE 2-continued

| Surfactant Component | First Surfactant Component | Second Surfactant Component | Water |
|---|---|---|---|
| 6 | 25% | 5% | 70% |
| 7 | 25% | 5% | 70% |
| 8 | 25% | 5% | 70% |
| 9 | 25% | 5% | 70% |
| 10 | 25% | 5% | 70% |
| 11 | 25% | 5% | 70% |
| 12 | 25% | 5% | 70% |
| 13 | 25% | 5% | 70% |
| 14 | 25% | 5% | 70% |
| 15 | 25% | 5% | 70% |
| 16 | 50% | 10% | 40% |
| 17 | 50% | 10% | 40% |
| 18 | 50% | 10% | 40% |
| 19 | 50% | 10% | 40% |
| 20 | 50% | 10% | 40% |
| 21 | 50% | 10% | 40% |
| 22 | 50% | 10% | 40% |
| 23 | 50% | 10% | 40% |
| 24 | 50% | 10% | 40% |
| 25 | 50% | 10% | 40% |
| 26 | 50% | 10% | 40% |
| 27 | 50% | 10% | 40% |
| 28 | 50% | 10% | 40% |
| 29 | 50% | 10% | 40% |
| 30 | 50% | 10% | 40% |
| 31 | 50% | 5% | 70% |
| 32 | 50% | 10% | 40% |
| 33 | 25% | 5% | 70% |
| 34 | 25% | 5% | 70% |
| 35 | 25% | 5% | 70% |
| 36 | 25% | 5% | 70% |
| 37 | 25% | 5% | 70% |
| 38 | 25% | 5% | 70% |
| 39 | 25% | 5% | 70% |
| 40 | 25% | 5% | 70% |
| 41 | 25% | 5% | 70% |
| 42 | 25% | 5% | 70% |

TABLE 3

| Comparative Surfactant Component | First Surfactant Component |
|---|---|
| 1 | 1 |
| 2 | 1 |
| 3 | 2 |
| 4 | 2 |

TABLE 4

| Comparative Surfactant Component | First Surfactant Component | Water |
|---|---|---|
| 1 | 25 | 75% |
| 2* | 50 | 50% |
| 3 | 25 | 75% |
| 4* | 50 | 50% |

*Comparative Surfactant Component was too viscous to measure

First Surfactant Component 1 comprises an ethylene oxide adduct of a $C_{16}$-$C_{18}$ alcohol and 80 moles of ethylene oxide in an amount of at least 95% by weight based on the total weight of First Surfactant Component 1.

First Surfactant Component 2 comprises an ethylene oxide adduct of a $C_{16}$-$C_{18}$ alcohol and 55 moles of ethylene oxide in an amount of at least 95% by weight based on the total weight of First Surfactant Component 2.

Second Surfactant Component 1 comprises an ethylene oxide adduct of a tridecyl alcohol and 3 moles of ethylene oxide in an amount of at least 95% by weight based on the total weight of Second Surfactant Component 1.

Second Surfactant Component 2 comprises an ethylene oxide adduct of a tridecyl alcohol and 6 moles of ethylene oxide in an amount of at least 95% by weight based on the total weight of Second Surfactant Component 2.

Second Surfactant Component 3 comprises an ethylene oxide adduct of a tridecyl alcohol and 8 moles of ethylene oxide in an amount of at least 95% by weight based on the total weight of Second Surfactant Component 3.

Second Surfactant Component 4 comprises an ethylene oxide adduct of a tridecyl alcohol and 10 moles of ethylene oxide in an amount of at least 95% by weight based on the total weight of Second Surfactant Component 4.

Second Surfactant Component 5 comprises an alkylene oxide adduct of a $C_{10}$-Guerbet alcohol with 1 mole of propylene oxide and 4 moles of ethylene oxide in an amount of at least 95% by weight based on the total weight of Second Surfactant Component 5.

Second Surfactant Component 6 comprises an alkylene oxide adduct of a $C_{10}$-Guerbet alcohol with 1 mole of propylene oxide and 6 moles of ethylene oxide in an amount of at least 95% by weight based on the total weight of Second Surfactant Component 6.

Second Surfactant Component 7 comprises an alkylene oxide adduct of a $C_{10}$-Guerbet alcohol with 1 mole of propylene oxide and 8 moles of ethylene oxide in an amount of at least 95% by weight based on the total weight of Second Surfactant Component 7.

Second Surfactant Component 8 comprises an alkylene oxide adduct of a $C_{10}$-Guerbet alcohol with 1 mole of propylene oxide and 10 moles of ethylene oxide in an amount of at least 95% by weight based on the total weight of Second Surfactant Component 8.

Second Surfactant Component 9 comprises an alkylene oxide adduct of a $C_{10}$-Guerbet alcohol with 1 mole of propylene oxide and 14 moles of ethylene oxide in an amount of at least 95% by weight based on the total weight of Second Surfactant Component 9.

Second Surfactant Component 10 comprises an ethylene oxide adduct of a $C_{10}$-Guerbet alcohol and 4 moles of ethylene oxide in an amount of at least 95% by weight based on the total weight of Second Surfactant Component 10.

Second Surfactant Component 11 comprises an ethylene oxide adduct of a $C_{10}$-Guerbet alcohol and 6 moles of ethylene oxide in an amount of at least 95% by weight based on the total weight of Second Surfactant Component 11.

Second Surfactant Component 12 comprises an ethylene oxide adduct of a $C_{10}$-Guerbet alcohol and 7 moles of ethylene oxide in an amount of at least 95% by weight based on the total weight of Second Surfactant Component 12.

Second Surfactant Component 13 comprises an ethylene oxide adduct of a $C_{10}$-Guerbet alcohol and 8 moles of ethylene oxide in an amount of at least 95% by weight based on the total weight of Second Surfactant Component 13.

Second Surfactant Component 14 comprises an ethylene oxide adduct of a $C_{10}$-Guerbet alcohol and 10 moles of ethylene oxide in an amount of at least 95% by weight based on the total weight of Second Surfactant Component 14.

Second Surfactant Component 15 comprises an ethylene oxide adduct of a $C_{10}$-Guerbet alcohol and 14 moles of ethylene oxide in an amount of at least 95% by weight based on the total weight of Second Surfactant Component 15.

Second Surfactant Component 16 comprises an alkylene oxide adduct of a $C_6$-$C_{10}$-Guerbet alcohol with 3 moles of propylene oxide and 8 moles of ethylene oxide in an amount of at least 95% by weight based on the total weight of Second Surfactant Component 16.

Second Surfactant Component 17 comprises an ethylene oxide adduct of isodecanol and 6 moles of ethylene oxide in an amount of at least 95% by weight based on the total weight of Second Surfactant Component 17.

Surfactant Components 1-42 and Comparative Surfactant Components 1-4 are evaluated for viscosity/temperature profiles as described above. The results of the evaluations are set forth in FIGS. 1-14.

Figure 13:
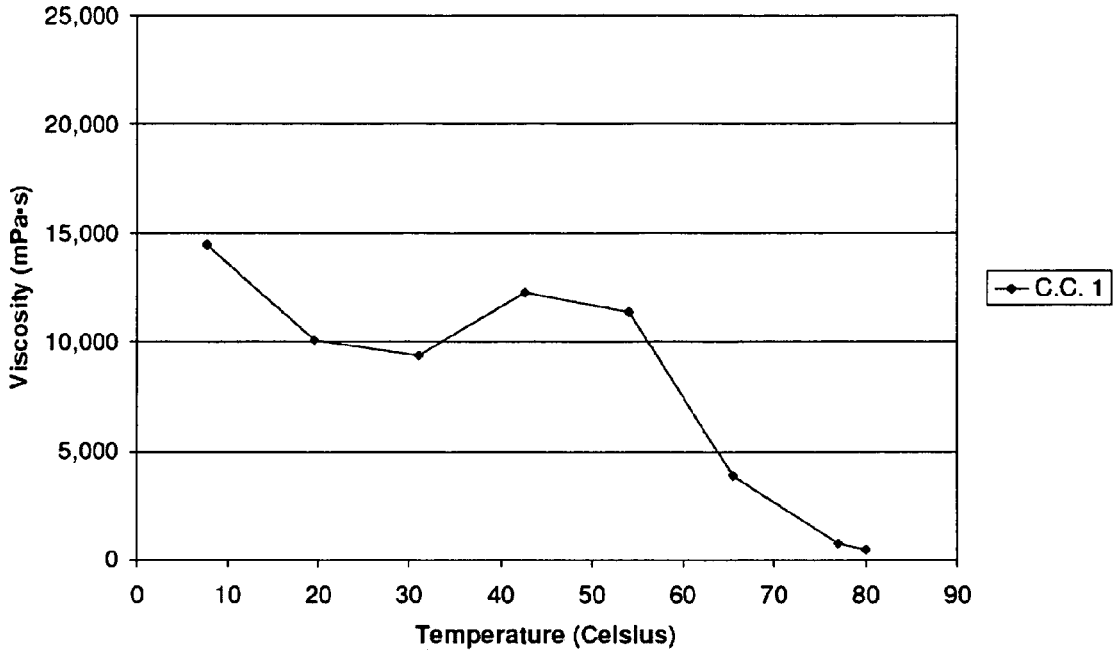
FIG. 13 is a line graph illustrating viscosity over a temperature range of from 8° to 80° Celsius of a first comparative example of a surfactant component comprising a first surfactant present in an amount of 25% by weight and water present in an amount of 75% by weight, both based on the total weight of the comparative surfactant component.
Figure 14:
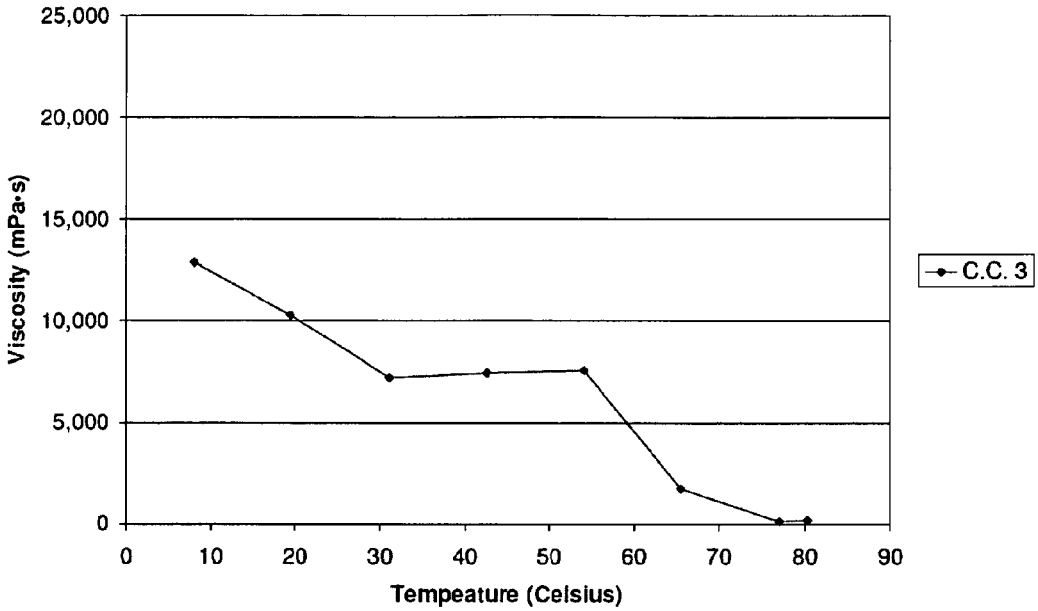
FIG. 14 is a line graph illustrating viscosity over a temperature range of from 8° to 80° Celsius of a third comparative example of a surfactant component comprising a first surfactant present in an amount of 25% by weight and water present in an amount of 75% by weight, both based on the total weight of the comparative surfactant component.

As can be seen from the data presented in FIGS. 1-14, Surfactant Components 2-4, 6-32, and 42 exhibit excellent viscosity measurements of less than 4,000 mPa·s at 40° Celsius. Additionally, Surfactant Components 4, 6, 11-16, 18, 19, 21-23, and 26-30 exhibit excellent viscosity measurements of less than 4,000 mPa·s at 25° Celsius. Referring to FIGS. 13 and 14 respectively, Comparative Surfactant Components 1 and 3 exhibit extremely high viscosity measurements of greater than 4,000 mPa·s at both 40° Celsius and 25° Celsius. Further, the Applicants could not evaluate Comparative Surfactant Components 2 and 4 for a viscosity/temperature profile since Comparative Surfactant Components 2 and 4 were too viscous. Accordingly, Surfactant Components 4, 6, 11-16, 18, 19, 21-23, and 26-30 outperform all other surfactant components and the Comparative Surfactant Component tested. This performance is thought to result, in part, from the second surfactant having structure-breaking properties interacting with the first surfactant in water therefore inhibiting gelling of the first surfactant in the water.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The present invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the present invention may be practiced otherwise than as specifically described.

The invention claimed is:

1. A surfactant component comprising:

(A) a first surfactant of the general formula:

$R^1$—O—$(A)_m$H wherein $R^1$ is a hydrocarbon group having from 14 to 22 carbon atoms, A is an alkyleneoxy group having from 2 to 4 carbon atoms, and m is greater than 30 to 150, said first surfactant present in an amount of from 1% to 50% by weight based on the total weight of said surfactant component;

(B) a second surfactant of the general formula:

$R^2$—O—$(B)_n$H wherein $R^2$ is a hydrocarbon group having from 6 to 14 carbon atoms, B is an alkyleneoxy group having from 2 to 4 carbon atoms, and n is from 3 to 20, said second surfactant present in an amount of at least 5% by weight based on the total weight of said surfactant component; and (C) water present in an amount of from 20% to 90% by weight based on the total weight of said surfactant component;

wherein said surfactant component has a viscosity of less than 4,000 mPa·s at 25° Celsius.

2. A surfactant component as set forth in claim 1 having a viscosity of less than 1,500 mPa·s at 25° Celsius.

3. A surfactant component as set forth in claim 1 wherein $R^2$ is further defined as a branched aliphatic hydrocarbon group.

4. A surfactant component as set forth in claim 3 wherein $R^2$ is further defined as a 2-propylheptane moiety.

5. A surfactant component as set forth in claim 1 wherein n is from 6 to 14.

6. A surfactant component as set forth in claim 1 wherein at least 75% of all alkyleneoxy groups present in said first surfactant are ethyleneoxy groups.

7. A surfactant component comprising:

(A) a first surfactant of the general formula:

$R^1$—O—$(A)_m$H wherein $R^1$ is an aliphatic hydrocarbon group having from 14 to 22 carbon atoms, A is an ethyleneoxy group, m is from 70 to 100, said first surfactant present in an amount of from 12% to 50% by weight based on the total weight of said surfactant component;

(B) a second surfactant of the general formula:

$R^2$—O—$(B)_n$H wherein $R^2$ is a 2-propylheptane moiety, B is an ethyleneoxy group, and n is from 6 to 14, said second surfactant present in an amount of at least 5% by weight based on the total weight of said surfactant component; and (C) water present in an amount of from 20% to 90% by weight based on the total weight of said surfactant component.

8. A composition comprising:

(A) a first surfactant of the general formula $R^1$—O-$(A)_m$H wherein $R^1$ is a hydrocarbon group having from 14 to 22 carbon atoms, A is an alkyleneoxy group having from 2 to 4 carbon atoms, and m is greater than 30 to 150, said first surfactant present in an amount of from 0.1% to 5% by weight based on the total weight of said composition;

(B) a second surfactant of the general formula $R^2$—$(B)_n$H wherein $R^2$ is a hydrocarbon group having from 6 to 14 carbon atoms, B is an alkyleneoxy group having from 2 to 4 carbon atoms, and n is from 3 to 20, said second surfactant present in an amount of at least 0.02% by weight based on the total weight said composition;

(C) water present in an amount of from 40% to 80% by weight based on the total weight of said composition; and (D) a water insoluble component having a water solubility of less than or equal to 1000 ppm at 25'Celsius present in an amount of from 0.5% to 50% by weight based on the total weight of said composition, wherein the first surfactant (A) and second surfactant (B) together have a viscosity of less than 4,000 mPa·s at 25° Celsius.

9. A composition as set forth in claim 8 wherein m is from 70 to 100.

10. A composition as set forth in claim 8 wherein $R^2$ is further defined as a branched aliphatic hydrocarbon group.

11. A composition as set forth in claim 10 wherein $R^2$ is further defined as a 2-propylheptane moiety.

12. A composition as set forth in claim 8 wherein n is from 6 to 14.

13. A composition as set forth in claim 8 wherein at least 75% of all alkyleneoxy groups present in said first surfactant are ethyleneoxy groups.

14. A composition as set forth in claim 8 wherein A and B are both further defined as an ethyleneoxy group.

15. A composition as set forth in claim 8 wherein said water insoluble component is further defined as a cationic active ingredient.

16. A method of forming a composition comprising the steps of:

(A) providing a surfactant component comprising a first surfactant of the general formula $R^1$—O-$(A)_m$H wherein $R^1$ is a hydrocarbon group having from 14 to 22 carbon atoms, A is an alkyleneoxy group having from 2 to 4 carbon atoms, and m is greater than 30 to 150, the first surfactant present in an amount of from 1% to 50% by weight based on the total weight the surfactant component; a second surfactant of the general formula $R^2$—O—$(B)_n$H wherein $R^2$ is a hydrocarbon group having from 6 to 14 carbon atoms, B is an alkyleneoxy group having from 2 to 4 carbon atoms, and n is from 3 to 20, the second surfactant present in an amount of at least 5% by weight based on the total weight of the surfactant component; water present in an amount of from 20% to 90% by weight based on the total weight of the surfactant component; and the surfactant component present in an amount of from 0.2% to 20% by weight based on the total weight of the composition;

(B) providing a water insoluble component having a water solubility of less than or equal to 1000 ppm at 25'Celsius present in an amount of from 0.5% to 50% by weight based on the total weight of the composition; and (C) mixing the surfactant component and the water insoluble component forming the composition, wherein said surfactant component has a viscosity of less than 4,000 mPa·s at 25° Celsius.

17. A method as set forth in claim 16 wherein providing the surfactant component further comprises grinding the first surfactant.

18. A method as set forth in claim 16 wherein m is from 70 to 100.

19. A method as set forth in claim 16 wherein $R^2$ is further defined as a branched aliphatic hydrocarbon group.

20. A method as set forth in claim 16 wherein $R^2$ is further defined as a 2-propylheptane moiety.

21. A method as set forth in claim 16 wherein n is from 6 to 14.

22. A method as set forth in claim 16 wherein at least 75% of all alkyleneoxy groups present in the first surfactant are ethyleneoxy groups.

23. A method as set forth in claim 16 wherein A and B are both further defined as an ethyleneoxy group.

24. A method as set forth in claim 16 wherein the water insoluble component is further defined as a cationic active ingredient.

25. A composition as set forth in claim 8, wherein $R^1$ is an aliphatic hydrocarbon group having from 16 to 18 carbon atoms.

26. A surfactant component comprising:

(A) a first surfactant of the general formula:

$$R^1—O—(A)_mH$$

wherein $R^1$ is an aliphatic hydrocarbon group having from 16 to 18 carbon atoms, A is an alkyleneoxy group having from 2 to 4 carbon atoms, and m is greater than 30 to 150, said first surfactant present in an amount of from 1% to 50% by weight based on the total weight of said surfactant component;

(B) a second surfactant of the general formula:

$$R^2—O—(B)_nH$$

wherein $R^2$ is a hydrocarbon group having from 6 to 14 carbon atoms, B is an alkyleneoxy group having from 2 to 4 carbon atoms, and n is from 3 to 20, said second surfactant present in an amount of at least 5% by weight based on the total weight of said surfactant component; and (C) water present in an amount of from 20% to 90% by weight based on the total weight of said surfactant component;

wherein said surfactant component has a viscosity of less than 4,000 mPa·s at 25° Celsius.

27. A surfactant component as set forth in claim 7 having a viscosity of less than 4,000 mPa·s at 40° Celsius.

* * * * *